US006937647B1

(12) United States Patent
Boyd et al.

(10) Patent No.: US 6,937,647 B1
(45) Date of Patent: Aug. 30, 2005

(54) EXTERNAL PERIMETER MONITORING SYSTEM

(75) Inventors: Randall D. Boyd, Knoxville, TN (US); Christopher E. Mainini, Knoxville, TN (US)

(73) Assignee: Radio Systems Corporation, Knoxville, TN (US)

( * ) Notice: Subject to any disclaimer, the term of this patent is extended or adjusted under 35 U.S.C. 154(b) by 0 days.

(21) Appl. No.: 09/522,087

(22) Filed: Mar. 10, 2000

(51) Int. Cl.[7] ..... G08B 13/00
(52) U.S. Cl. ..... 375/228; 119/721; 702/128
(58) Field of Search ..... 375/228, 240.16; 340/500–693.12; 702/128; 119/721

(56) References Cited

U.S. PATENT DOCUMENTS 4,656,463 A * 4/1987 Anders et al. ..... 340/573.4
5,576,972 A * 11/1996 Harrison ..... 702/128
6,204,762 B1 * 3/2001 Dering et al. ..... 340/541

* cited by examiner

*Primary Examiner*—Stephen Chin
*Assistant Examiner*—Curtis Odom
(74) *Attorney, Agent, or Firm*—Pitts & Brittian, P.C.

(57) ABSTRACT

A system for monitoring activity along a wire-bounded perimeter. The monitoring system includes a single-conductor wire which bounds a protected area. In communication with the wire at predetermined locations is a series of sensors which are either physically or inductively coupled to the wire. The sensors measure activity the wire bounded perimeter. The measured activity is analyzed by the transponder unit which categorizes the activity. The monitoring system can operate as a stand-alone system or be integrated with a conventional residential and light commercial security system. Further, the monitoring system may incorporate a pet containment transmitter for use with an electronic pet containment system.

19 Claims, 5 Drawing Sheets

EXTERNAL PERIMETER MONITORING SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of Invention

This invention relates to a system for monitoring an outdoor perimeter. More particularly, this invention relates to a system for monitoring activity along a wire bounded perimeter.

2. Description of the Related Art

Residential and light commercial security systems have become an increasingly popular addition to many homes and businesses. These systems are typically based on the electronic detection of a breach in the perimeter of the structure. A breach is detected at either the perimeter itself or the interior of the structure. The perimeter is generally defined as the entrance/egress points to a structure such as doors and windows. Perimeter breaches are generally detected by magnetic sensors which monitor the opening and closing of doors and windows and by frequency sensors attuned to the sound of glass breakage. Interior breaches are generally detected by heat and motion detectors which monitor moving objects having a temperature greater than the ambient temperature. While providing a warning of intrusion, both the detection of perimeter and interior breaches occur after damage to the structure or entry has been obtained.

Similarly, motion sensors are used to turn on outdoor lighting thereby providing a deterrent to intrusion onto the property. However, these sensors are indiscriminate in that they may be triggered by small animals, children, or other moving objects which are not considered security risks. Further, because of the difficulty in accurately setting the range of each sensor, the limited sensor range, and the arcuate detection zone of each sensor, setting up a comprehensive coverage area limited to the boundaries of one's property is difficult at best. Finally, it should be noted that while the external sensors could be connected to a central alarm system, the inability to discriminate between legitimate security risks and stray animals and the difficulty in defining the protection area render such a system unreliable.

Ideally, a monitoring system could identify and announce activity along the monitored perimeter. Accordingly, there is a need for a monitoring system which allows a boundary of protection to be easily defined. Further, there is a need for a monitoring system capable of identifying potential threats to security so as to avoid false alarms.

Therefore, it is an object of the present invention to provide a monitoring system which permits a fixed protection boundary to be defined.

It is another object of the present invention to provide a monitoring system which detects activity along the borders of the protection area.

Yet another object of the present invention is to provide a monitoring system which discriminates between various types of activity.

It is a further object of the present invention to provide a monitoring system which can be integrated with an existing residential and light commercial security system.

A still further object of the present invention is to provide a monitoring system which can be added into an existing pet containment system.

Yet a still further object of the present invention to provide a monitoring system which defines the protected area using a single wire.

BRIEF SUMMARY OF THE INVENTION

A system for detecting activity along a wire-bounded perimeter is provided. The system includes a single-conductor wire which bounds an area defined as the protected area. Electrically connected to the wire at predetermined locations is a series of sensors and a transponder.

The transponder serves as the controller for the system. Each of the sensors is provided with a unique identification, or address, allowing the transponder to communicate with a selected sensor. Communication is accomplished using an addressable data packet transmitted along the wire using a frequency shift keying technique.

The sensors of the present invention each include a communication interface, a transceiver, a DC power source, and an activity measuring device. There are two general types of sensors used in the present invention. First are the wired sensors wherein the communication interface is a transformer physically coupled to the wire. Next are the mobile sensors which operate without actual physical connection to the wire. The communication interface of the mobile sensors is a single-turn, inductive antenna placed near, but not directly over, the wire and oriented in a substantially vertical orientation with respect to the wire, thereby creating a mutual inductive coupling allowing bidirectional communication. The signal transmitted through the wire generally includes a power signal, or carrier, to which a modulated data signal is attached. The timing of the data signals is controlled by the transponder.

Each of the sensors is provided with a unique identification, or address, allowing the transponder to communicate with a particular sensor. Communication is accomplished using a data packet having a header containing at least a frame synchronization code, at least one command character, at least one address character, and a security code. The command packet is transmitted through the wire using any appropriate modulation scheme.

When a request is received by the sensor, the activity measurement device is activated to detect local activity through one of a variety of detection methods. The activity measuring device is positioned and adjusted such that activity near or approaching the perimeter of the protected area from the outside is detected. The detected activity signal is then encoded by the microprocessor and transmitted to the transponder by the transceiver. The transponder comparison device compares the measured activity signal to exemplary activity profiles from selected activity sources, such as vehicles, animals, and humans. A result generated from the comparison is generated and interpreted by the transponder processing device. Should activity be detected, the transponder processing device then generates an alert which is transmitted to a user through the indicator and/or to an external conventional residential and light commercial security system through the external interface.

BRIEF DESCRIPTION OF THE SEVERAL

VIEWS OF THE DRAWINGS

The above-mentioned features of the invention will become more clearly understood from the following detailed description of the invention read together with the drawings in which.

DETAILED DESCRIPTION OF THE INVENTION

A system for a monitoring a wire-bounded perimeter is illustrated generally at 10 in the figures. The system for monitoring a wire bounded perimeter, or monitoring system 10, uses at least one sensor 14 located at a predetermined location around a protected area 13 to identify activity at the perimeter of the protected area 13.

Figure 1:
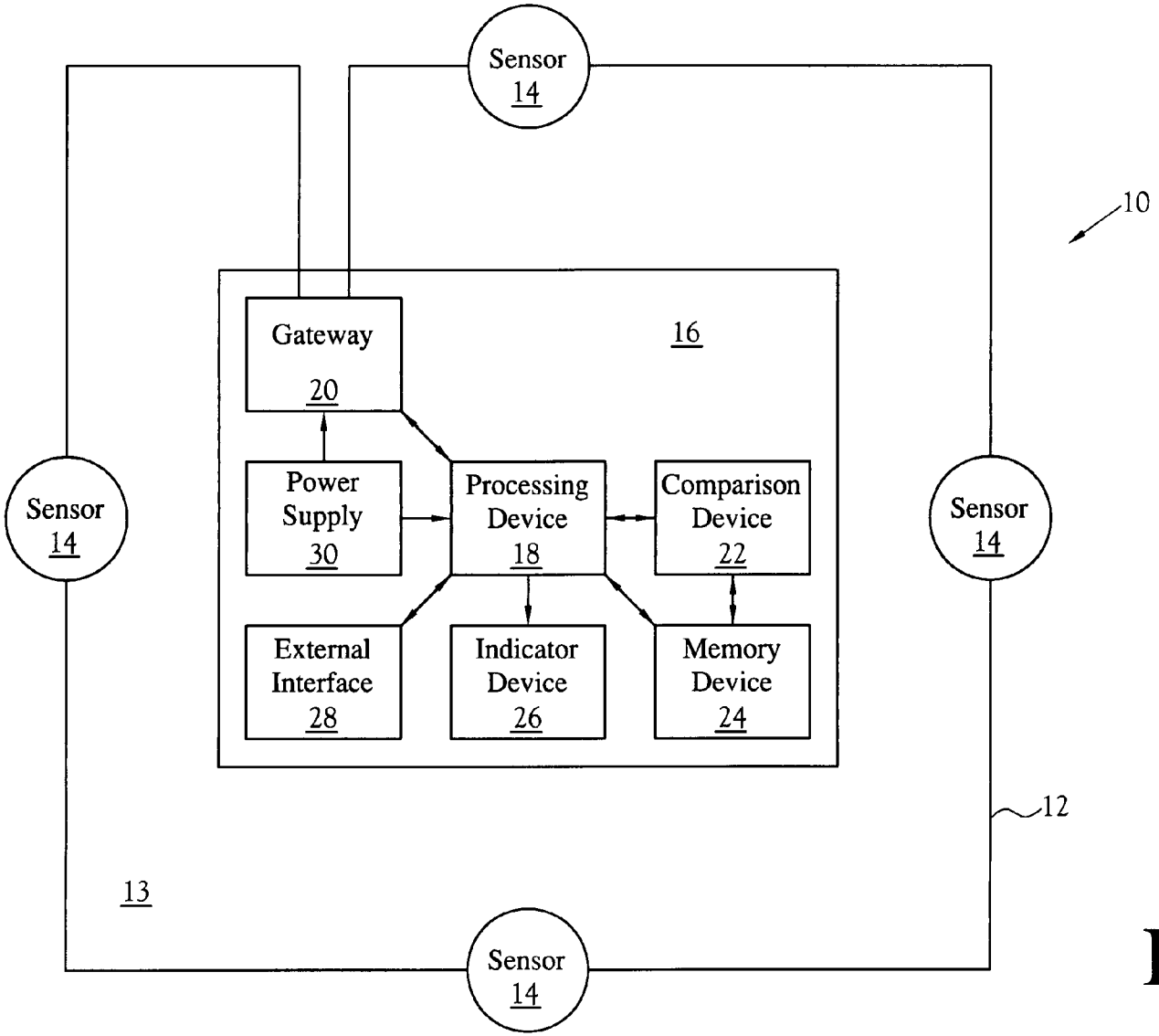
FIG. 1 is a block diagram of a system for monitoring a wire bounded perimeter showing various features of the transponder of the present invention.

FIG. 1 illustrates a block diagram of the monitoring system 10 of the present invention. The monitoring system 10 includes a single-conductor wire 12 which bounds an area defined as the protected area 13. Electrically connected to the wire 12 at predetermined locations are a series of sensors 14 and a transponder 16. In the illustrated embodiment, the transponder 16 includes a processing device 18, a gateway 20, a comparison device 22, a memory device 24, an indicator 26, an external interface 28, and a power supply 30. Corresponding elements of the monitoring system 10 are labeled with like numerals.

The transponder 16 serves as the controller for the monitoring system 10. Specifically, the transponder 16 supplies power, receives data from the sensors 14, processes the received data, displays information about the processed data, and communicates with external devices, such as a conventional residential and light commercial security system (not shown). The transponder processing device 18 sequences the operation of these functions. One skilled in the art will recognize that the processing device may be implemented in a variety of ways including discrete logical components (not shown) and a microprocessor (not shown). In the illustrated embodiment, the transponder processing device 18 is a microprocessor to allow the functionality of the transponder 16 to be varied, with minimal hardware changes, through the use of software. Typical functions of the transponder processing device 18 include providing timing to control signal traffic across the wire 12, requesting information from the sensors 14, and analyzing the information received from the sensors 14. Additionally, the transponder processing device 18 generates an output which is sent to an external interface 24. The external interface 24 translates the output into a form which is usable by a conventional residential and light commercial security system allowing the perimeter monitoring system 10 of the present invention to be integrated with an existing structural intrusion detection system. Such integration allows the perimeter monitoring system 10 to be monitored by an off-premises security monitoring company.

Many of these functions compete for transmission time across the single conductor wire 12. The gateway 20 manages access to the wire 12. One skilled in the art will recognize that a variety of electrical components can be used to implement the gateway 20 including switches, multiplexers, gates, and universal asymmetric receiver-transmitters (UARTs). In the illustrated embodiment the gateway 20 is a UART responsive to the transponder processing device 18. Generally, the transponder processing device 18 directs the gateway 20 which of the various signals has the right-of-way on the wire 12. Among the signals competing for use of the wire 12 are information signals directed to one or more sensors 14 from the transponder processing device 18, and information signals from one or more sensors 14 directed to the transponder processing device 18. In general, the wire 12 carries a power signal from the power supply 30. Data signals are encoded into the base signal by applying a modulation technique, such as frequency shift keying.

To monitor activity near the perimeter of the protected area 13, the transponder 16 requests information from each sensor 14 by sending a data packet containing the appropriate command characters to the particular sensor 14. When energized, each sensor 14 detects local activity and sends the detected activity signal to the transponder 16 for processing. The transponder 16 compares the detected activity to a variety of exemplary activity signals. Using the comparison result, the transponder then categorizes detected activity within one of the predetermined classes. One skilled in the art will recognize that various types of sensors 14 can be used depending upon the desired monitoring capabilities of the system, including, but not limited to, seismic, infrared, and audio sensors. Further, one skilled in the art will recognize that various levels of sophistication in the discrimination process can be used to provide more specific identification of the activity source.

Figure 2:
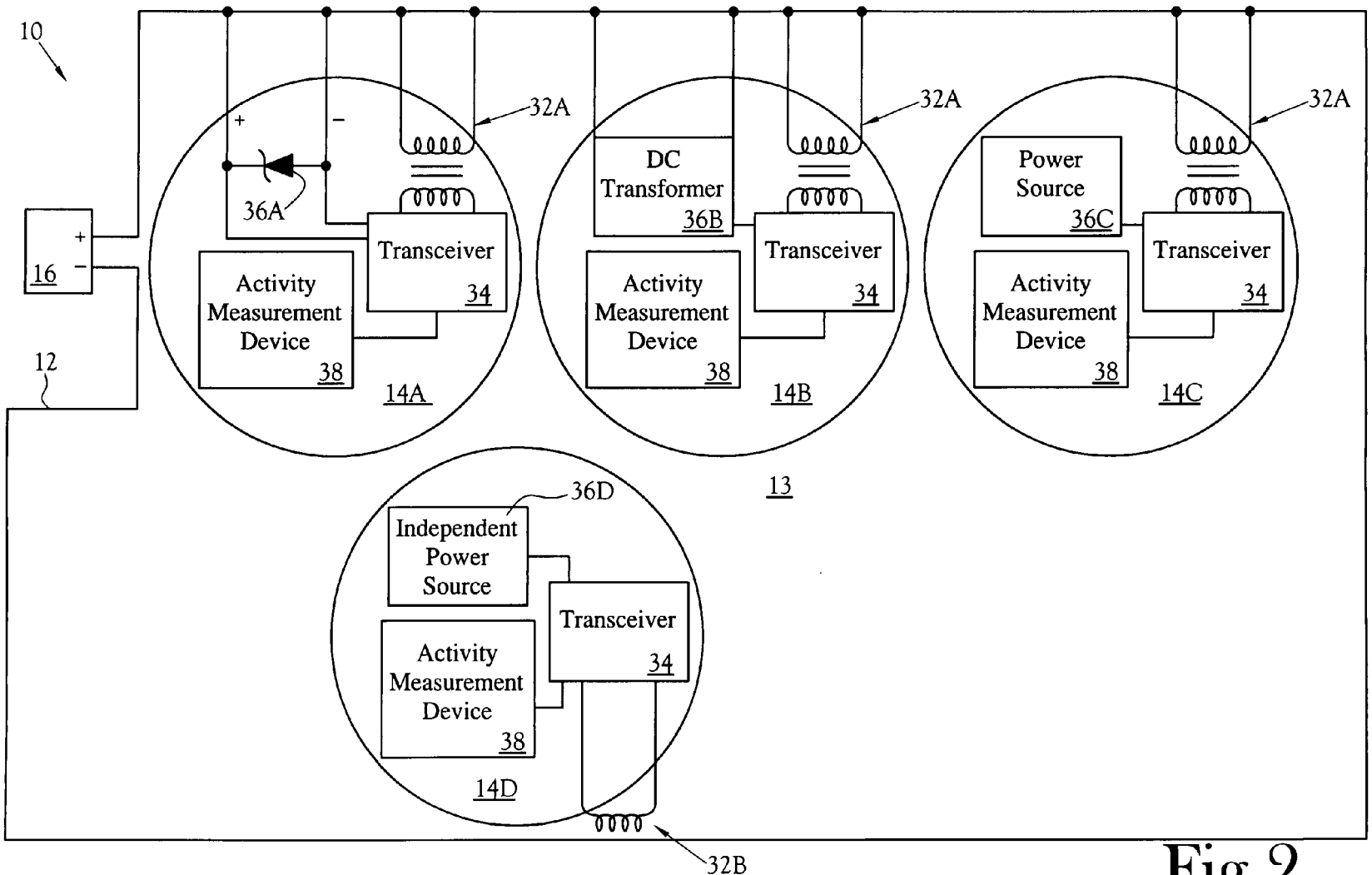
FIG. 2 is a block diagram of a system for monitoring a wire bounded perimeter showing various embodiments of the sensors of the present invention.

FIG. 2 illustrates a block diagram of the present invention with emphasis on the various embodiments of the sensors 14. The sensors 14 each include a communication interface 32, a transceiver 34, a DC power source 36, and an activity measuring device 38. There are two general types of sensors 14 used in the present invention. First are the wired sensors 14A, 14B, 14C. In each of the wired sensors 14A, 14B, 14C, the communication interface 32 is a transformer physically coupled to the wire 12. Next is the mobile sensor 14D, which operates without actual physical connection to the wire 12. The communication interface 32 of the mobile sensor 14D is a single-turn, inductive antenna placed near, but not directly over, the wire 12 and oriented in a substantially vertical orientation with respect to the wire 12, thereby creating a mutual inductive coupling allowing bidirectional communication. In the illustrated embodiment, a variety of DC power sources 36 are shown. First is a power conditioning in-line zener diode 36A connected to wire 12 for generating a DC voltage drop used to power the sensor 34. Next is a DC transformer 36B for converting the AC voltage traveling through wire 12 into a DC voltage. Finally, an independent power source 36C, 36D is shown. The independent power source 36C, 36D can be a battery or a solar cell. One skilled in the art will recognize that the independent power source 36D provides the greatest benefit when used in a mobile sensor 14D such that it can be readily moved without the need for connection to an external power source.

Each of the sensors 14 is provided with a unique identification, or address, allowing the transponder 16 to communicate with a particular sensor 14. Communication is accomplished using a data packet having a header containing at least a frame synchronization code, at least one command character, at least one address character, and a security code. One skilled in the art will recognize that other information may be included including, but not limited to, packet size and checksum information. In the illustrated embodiment, the data packet is transmitted using an RS-232 data format. The frame synchronization code is made up of sixteen (16) consecutive logical one bits coupled with no more than four (4) stop bits between the characters in the data packet. The command packet is transmitted through the wire 12 using any appropriate modulation scheme. The preferred embodiment utilizes frequency shift keying (FSK) for transmitting the data packet. One method for implementing a FSK transmission is to use a higher frequency, such as 18 kHz, to transmit a logical one and a lower frequency, such as 14 kHz, to transmit a logical zero.

Figure 3:
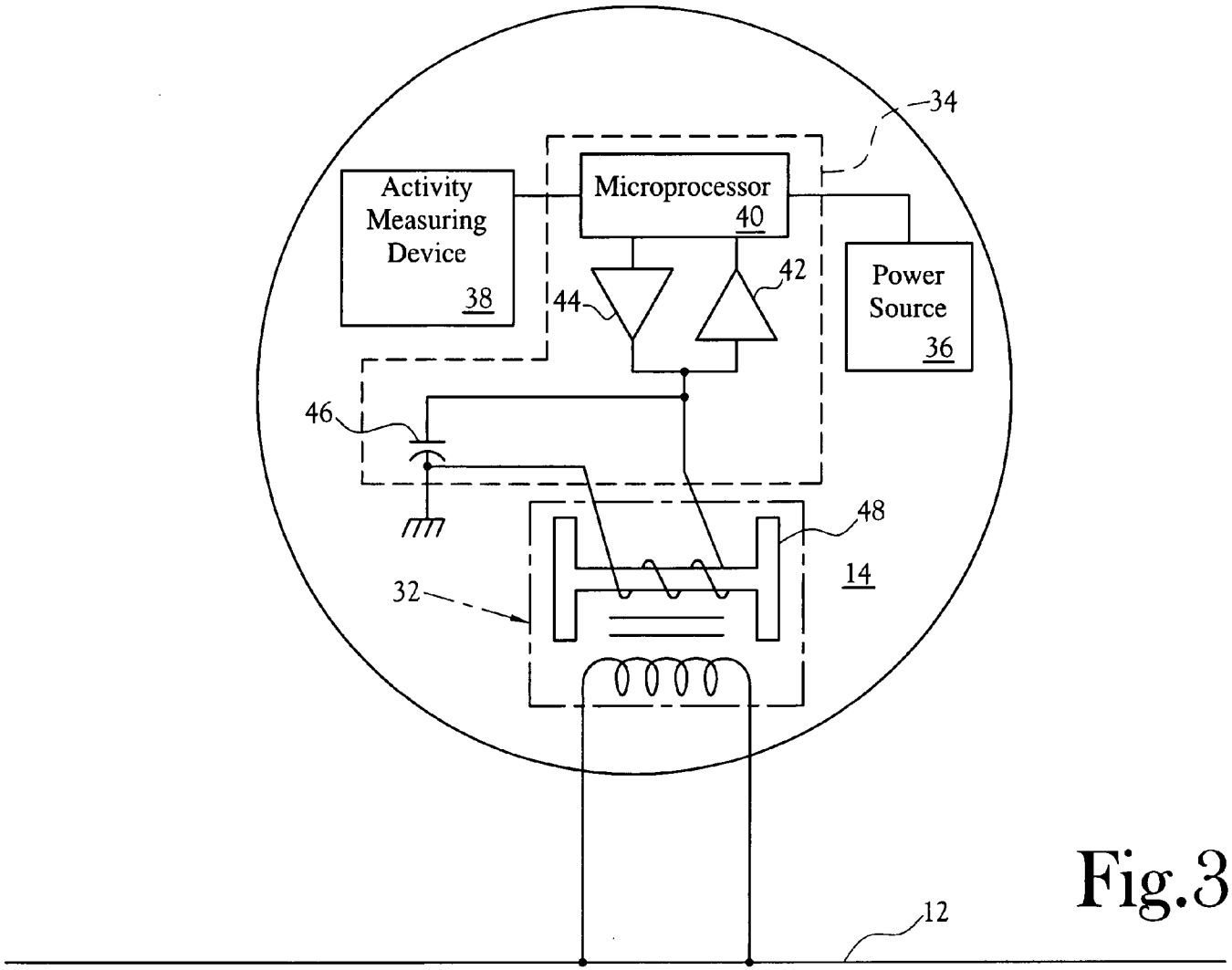
FIG. 3 is a block diagram of a sensor showing various features of the present invention.

FIG. 3 illustrates the sensor 14 of the present invention. The transceiver 34 includes a sensor processing device 40, a limiting amplifier 42, a driving amplifier 44, and a frequency tuner 46 in communication with a tightly wound ferrite core antenna 48 for monitoring an electromagnetic field for disruptions and for communicating with the transponder 16. In the illustrated embodiment, the frequency tuner 46 is a capacitor selected to tune the transceiver to the frequency having the desired sensitivity. In the stand-by, or receiver, mode, the driving amplifier 44 is turned off allowing the ferrite core antenna 48 to pick up the signal being carried through the wire 12. The limiting amplifier 42 amplifies the received signals into logical ones and zeros and presented to the sensor processing device 40 for period measurement using a frequency discrimination technique suited for a small microprocessor. In the illustrated embodiment, frequency discrimination is achieved by comparing the measured period to a predetermined threshold level. Conversely, in transmitter mode, the driving amplifier 44 is activated and the desired transmission frequency generated by the sensor processing device 40 for the current response character is impressed on the input to the driving amplifier 44 and broadcast by the ferrite core antenna 48.

When a request is received by the sensor 14, the activity measurement device 38 is activated to detect local activity. The activity measuring device 38 is positioned and adjusted such that activity near to or approaching the perimeter of the protected area 13 from the outside are detected. The detected activity signal is then encoded by the microprocessor 32 and transmitted to the transponder 16, of FIG. 1, by the transceiver 34. Returning now to the illustrated embodiment of FIG. 1, a digital signal processing device 21 conditions the signal and the transponder comparison device 22 compares the detected activity signal to exemplary activity profiles from selected sources, such as vehicles, animals, and humans, which are stored in the transponder memory device 24. A result generated from the comparison is generated and interpreted by the transponder processing device 18. In the illustrated embodiment, the transponder processing device 18 is configured to generate one of four responses: vehicle, human, animal, or no activity, along with the identification of the sensor 14 where the response was generated. Should activity meeting determined characteristics be detected, the transponder processing device 18 then generates an alert which is transmitted to a user through the indicator 26 and/or to an external conventional residential and light commercial security system through the external interface 28. One skilled in the art will recognize that the transponder processing device 18 can be configured to selectively transmit alert signals to the various outputs. For example, in one embodiment, when an animal is detected, the monitoring system 10 displays an alert at the indicator 26 but does not pass any information on through the external interface 28. Similarly, where a human is detected, alerts are sent to both the indicator 26 and the external interface 28. Further, one skilled in the art will recognize that the indicator 22 can vary depending upon the type and amount of information offered to the user. In the illustrated embodiment, the indicator 22 is a multi-line, alphanumeric display screen which can display the time, date, location, and type of activity. Other types of indications could be utilized, such as audio tones or light-emitting diodes representing a specific condition or location. Finally, one skilled in the art will recognize that other types of information can be communicated through the indicator 22 including, but not limited to, diagnostic information and system status.

Figure 4:
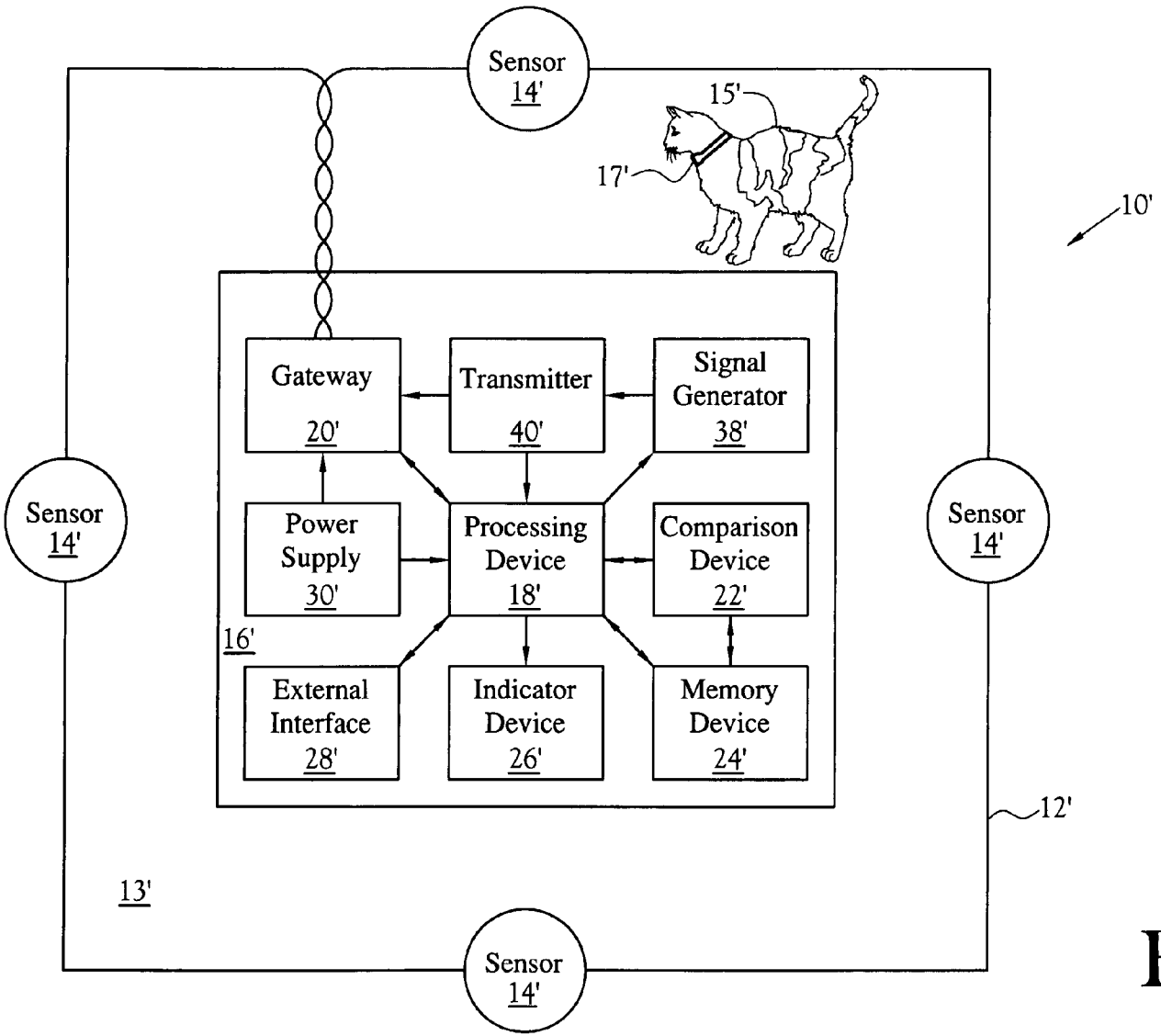
FIG. 4 is a block diagram of an alternate embodiment of the system of the present invention incorporating a pet containment transmitter to provide additional functionality.

FIG. 4 illustrates the monitoring system 10' of the present invention incorporating an electronic pet containment function known to those skilled in the art. To implement the pet containment function, the transponder 16' additionally includes a signal generator 38' and a transmitter 40'. The signal generator generates a radio frequency modulated electromagnetic signal of the type used in typical pet containment systems. The transmitter 40' transmits the containment signal through the wire 12'. The pet 15' to be confined wears a receiver 17' configured to receive the containment signal and apply a corrective stimulus upon a predetermined trigger. Because the containment signal must coexist with the other information traveling along the wire 12', the containment signal is routed through the gateway 20' and the timing of the containment signal is controlled by the transponder processing device 18'.

Figure 5:
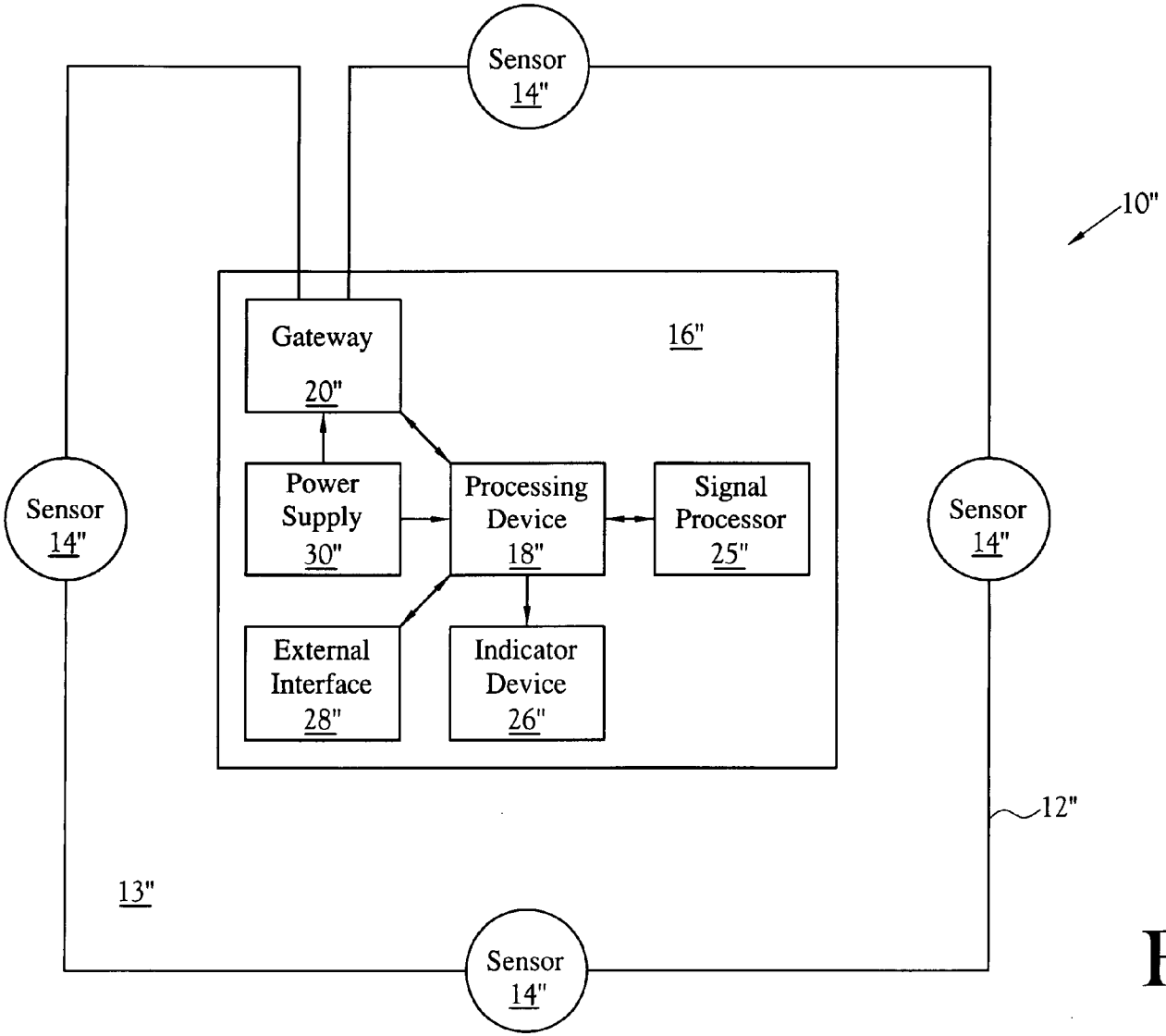
FIG. 5 is a block diagram of an alternate embodiment of the transponder of FIG. 1 replacing the memory and comparison devices with a digital signal processor.

FIG. 5 illustrates a block diagram of a transponder 12" using an alternate method of classifying the detected activity signals. The transponder 12" replaces the comparison device 22 and the memory device 24 with a digital signal processing device 25". The digital signal processing device 25" applies a digital filter to each detected activity signal. The filtered activity signal is then classified based on the response characteristics by the processing device 18". The transponder 12" incorporating the digital signal processing device 25" is uniquely suited to use with a variety of sensor types. For example, the digital signal processing device 25" can be configured to apply to differing digital filters to each detected activity signal based upon the sensor type, thereby allowing the processing device 18" to identify activity in a number of differing forms and respond appropriately.

One skilled in the art will recognize that the ultimate function of the monitoring system 10 is to detect and categorize the activity prior to penetration of the protected area 13. In this regard, various components of the system are interchangeably located without interfering with the objects of the present invention. Specifically, the signal processing device, the comparison device, the memory device, and the processing device may be located in each sensor 14 so that the transponder 16 simply collects the results and displays the information.

One skilled in the art will recognize that both the transponder 16 and the sensors 14 can include additional electronics, including modulators, demodulators, amplifiers, filters, etc., to enhance the basic function, accuracy, and reliability of the present invention without interfering with the objects of the present invention. Further, one skilled in the art will recognize that, within each of the transponder 16 and the sensors 14, signals can be communicated between the various components using a variety of methods including the use of a bus.

What has been disclosed is an external perimeter monitoring system using strategically placed sensors connected to a transponder by a single conductor wire bus through which data signals and power signals are sequenced. Activity detected at the sensors is analyzed to classify the source of the activity and an alert is generated if necessary. The external perimeter monitoring system is capable of interfacing with a conventional residential or light commercial security system to allow off-premises monitoring. Further, an alternate embodiment of the external perimeter monitoring system is integrated with a conventional electronic pet confinement system allowing the single conductor wire bus to serve as a radio frequency antenna defining the confinement boundary with the confinement signal added to the data signal and power signal sequencing.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A system for monitoring activity along an area bounded by a wire, said system comprising:

a single conductor wire defining a boundary around an area;

at least one sensor in communication with said wire, said at least one sensor for measuring local activity as a measured local activity signal and transmitting said measured local activity signal through said wire;

a gateway electrically connected to said wire, said gateway for managing transmissions through said wire;

a digital signal processing device in electrical communication with said gateway, said digital signal processing device for applying a digital filter to each said measured local activity signal to produce a filtered activity signal;

a processing device in electrical communication with said gateway and said digital signal processing device; said processing device for sequencing operation of said monitoring system, communicating with said at least one sensor, and identifying said filtered activity signal to produce an activity identification;

a power supply providing power to said system, said power supply electrically connected to said gateway for transmitting power through said wire to said sensors; and an indicator responsive to said processing device for communicating said activity identification.

2. The system of claim 1 further comprising an external interface in communication with said processing device, said external interface configured for interfacing the monitoring system with a conventional residential and light commercial security system.

3. The system of claim 1 further comprising a signal generator for generating an electromagnetic signal, said signal generator being electrically connected to a transmitter for transmitting said electromagnetic signal through said wire, said transmitter electrically connected to said gateway, said electromagnetic signal broadcast from said wire such that a receiving device responsive to said electromagnetic signal provides a corrective stimulus to a pet wearing said receiving device when the pet approaches said wire.

4. The system of claim 1 wherein each said at least one sensor is individually addressable.

5. The system of claim 1 wherein said at least one sensor is selected from the group consisting of at least seismic, infrared, and audio sensors.

6. The system of claim 1 wherein said at least one sensor comprises a sensor power source, an activity measuring device, a transceiver, and a communication interface.

7. The system of claim 6 wherein said communication interface is a transformer electrically coupled to said wire.

8. The system of claim 6 wherein said communication interface includes an antenna oriented vertically with respect to said wire and wherein each said at least one sensor is located near but not directly over said wire and a ferrite core antenna electrically connected to said transceiver.

9. The system of claim 6 wherein said transceiver includes a tuner electrically connected to said communication interface for tuning said transceiver to a predetermined frequency, an amplifier electrically connected to said communication interface for converting signals received from said communication interface into logical ones and zeros, a processing device electrically connected to said amplifier, said activity measuring device, and said power supply for interpreting said logical ones and zeros, and a driver electrically connected to said processing device and said communication interface for sending a measured activity signal obtained from said activity measuring device through said communication interface.

10. A system for monitoring activity along an area bounded by a wire, said system comprising:

a single conductor wire defining a boundary around an area;

at least one sensor in communication with said wire, said at least one sensor for measuring local activity as a measured local activity signal and transmitting said measured local activity signal through said wire;

a gateway electrically connected to said wire, said gateway for managing transmissions through said wire;

a comparison device in electrical communication with said gateway, said comparison device for comparing said measured local activity signal to at least one reference signal and producing a comparison result;

a processing device in electrical communication with said gateway and said comparison device; said processing device for sequencing operation of said monitoring system, communicating with said at least one sensor, and identifying said comparison result to produce an activity identification;

a power supply for providing power to said system, said power supply electrically connected to said gateway for transmitting power through said wire to said sensors; and an indicator responsive to said processing device for communicating the comparison result with an operator.

11. The system of claim 10 further comprising a memory device in electrical communication with said comparison device for storing said at least one reference signal.

12. The system of claim 10 wherein each said at least one sensor is individually addressable.

13. The system of claim 10 further comprising a signal generator for generating an electromagnetic signal, said signal generator being electrically connected to a transmitter for transmitting said electromagnetic signal through said wire, said transmitter electrically connected to said gateway, said electromagnetic signal broadcast from said wire such that a receiving device responsive to said electromagnetic signal provides a corrective stimulus to a pet wearing said receiving device when the pet approaches said wire.

14. The system of claim 10 wherein said at least one sensor is selected from the group consisting of at least seismic, infrared, and audio sensors.

15. The system of claim 10 further comprising an external interface in communication with said processing device, said external interface configured for interfacing the monitoring system with a conventional residential and light commercial security system.

16. The system of claim 10 wherein said at least one sensor comprises a sensor power supply, an activity measuring device, a transceiver, and a communication interface.

17. The system of claim 16 wherein said communication interface is a transformer electrically coupled to said wire.

18. The system of claim 16 wherein said communication interface includes an antenna oriented vertically with respect to said wire and wherein each said at least one sensor is located near but not directly over said wire and a ferrite core antenna electrically connected to said transceiver.

19. The system of claim 16 wherein said transceiver includes a tuner electrically connected to said communication interface for tuning said transceiver to a predetermined frequency, an amplifier electrically connected to said communication interface for converting signals received from said communication interface into logical ones and zeros, a processing device electrically connected to said amplifier, said activity measuring device, and said power supply for interpreting said logical ones and zeros, and a driver electrically connected to said processing device and said communication interface for sending a measured activity signal obtained from said activity measuring device through said communication interface.

* * * * *